US006244970B1

(12) United States Patent
Sullivan et al.

(10) Patent No.: US 6,244,970 B1
(45) Date of Patent: Jun. 12, 2001

(54) OPTICAL SENSORS FOR CUE BALL DETECTION

(75) Inventors: Robert G. Sullivan, New Albany, IN (US); Steven Mersch, Germantown, OH (US)

(73) Assignee: Diamond Billiard Products, Inc., New Albany, IN (US)

( * ) Notice: Subject to any disclaimer, the term of this patent is extended or adjusted under 35 U.S.C. 154(b) by 0 days.

(21) Appl. No.: 09/335,339

(22) Filed: Jun. 17, 1999

Related U.S. Application Data

(60) Provisional application No. 60/089,845, filed on Jun. 19, 1998.

(51) Int. Cl.[7] ..... A63B 37/00

(52) U.S. Cl. ..... 473/53; 473/52

(58) Field of Search ..... 473/52–53, 220, 473/FOR 52–FOR 54; 435/808; 273/118 D, 118 R; 463/7, 31; 359/618

(56) References Cited

U.S. PATENT DOCUMENTS 2,825,565 * 3/1958 Hooker ..... 473/53
4,015,845 * 4/1977 Sines ..... 473/53
4,042,491 * 8/1977 Hazeltine et al. ..... 473/53
5,255,916 * 10/1993 Bleich ..... 273/118 D
5,846,138 * 12/1998 Borden et al. ..... 473/54

FOREIGN PATENT DOCUMENTS

2653349 * 4/1997 (FR) ..... 473/53

* cited by examiner

*Primary Examiner*—Stephen F. Gerrity
*Assistant Examiner*—Mitra Aryanpour
(74) *Attorney, Agent, or Firm*—Woodard, Emhardt, Naughton, Moriarty & McNett

(57) ABSTRACT

Two optical techniques for selective detection of a regular-sized, standard cue ball. Both techniques make it possible to distinguish a regular-sized, standard size cue ball from object balls within a standard set. The first technique is called the "optical density discrimination" technique. It is based on the fact that the optical density of the cue ball is significantly less than the optical density of the object balls. The second technique is called the "fluorescence discrimination" technique. It requires that the cue ball be manufactured with a fluorescent pigment in its outer surface during manufacture. Discrimination is then based on detecting the fluorescence of the cue ball.

8 Claims, 4 Drawing Sheets

OPTICAL SENSORS FOR CUE BALL DETECTION

This application claims the benefit of U.S. Provisional Patent Application Ser. No. 60/089,845, filed Jun. 19, 1998.

The present invention relates to billiard tables, generally, and more particularly to optical sensing devices used in the ball return mechanism of a billiard table to segregate a regular-sized, standard cue ball from object balls.

BACKGROUND OF THE INVENTION

A billiard table is widely used in a variety of games, such as eight ball, snooker, etc. In all of these games players commonly use a cue stick to hit a white cue ball, which in turn strikes a colored numbered ball, known as an object ball, which the players direct into the pockets of the billiard table. The cue ball and object balls are returned together in a standard billiard table but the cue ball and object balls are segregated via mechanical or magnetic means in the typical commercial table of the prior art.

In a commercial table, it is desirable to segregate the cue ball from the object balls so that the cue ball is returned to the players all times, while the object balls are being collected in a central location. In existing commercial tables, the cue ball is either larger than the object balls or the cue ball has a magnetic core to allow the cue ball to be physically segregated from the object balls. Both of these physical changes to the cue ball affect the play of the cue ball and therefore detract from the competitiveness of games.

By detecting the presence of a regular-sized, standard cue ball (without a magnetic core) within a standard set of object balls and then by sorting the cue ball from the object balls, the play of games would be significantly enhanced. In addition, the development of a regulation commercial table would be possible.

SUMMARY OF THE INVENTION

The present invention includes two optical techniques for selective detection of a regular-sized, standard cue ball. Both techniques make it possible to distinguish a regular-sized, standard size cue ball from object balls within a standard set. The first technique is called the "optical density discrimination" technique. It is based on the fact that the optical density of the cue ball is significantly less than the optical density of the object balls. The second technique is called the "fluorescence discrimination" technique. It requires that the cue ball be manufactured with a fluorescent pigment in its outer surface during manufacture. Discrimination is then based on detecting the fluorescence of the cue ball.

The "optical density discrimination" technique works as follows. An LED (either red or infrared) is modulated and pointed to illuminate a portion of the cue ball in such a way that all specular reflections are directed away from a detector. The detection system includes a detector, synchronous detection circuit, threshold, and npn output. The detector is positioned such that light from the LED must travel through at least a portion of the volume of the cue ball in order to reach the detector. The detector threshold is set such that a cue ball, with its lower optical density, produces a signal at the detector of sufficient strength to exceed a threshold and activate the npn output. All object balls, with their higher optical density, fail to activate the output. Modulation of the LED and synchronous detection ensures insensitivity to ambient light.

The "fluorescence discrimination" technique is similar to the optical density technique except that the wavelength of the light source is selected such that it excites the fluorescent material within the cue ball. The detector is filtered to detect only the fluorescence given off by the fluorescent material within the cue ball. In this way only the cue ball generates sufficient signal at the detector to cause activation of the output.

One embodiment of the present invention is an optical sensor for distinguishing a cue ball from an object ball, comprising a light emitting source with means to concentrate or limit its illumination to a portion of a cue ball; a detector responsive to the wavelength emitted by the light emitting source having means to limit the field of view of the detector to an area of the cue ball not directly illuminated by the light emitting source; means to produce an electrical current proportional to the detected light striking the detector; and means to generate an output signal from the sensor when detected light striking the detector generates an electrical current of a predetermined amplitude.

Another embodiment of the present invention is an optical sensor for distinguishing a cue ball having a fluorescent pigment therein from an object ball, comprising a light emitting source that emits excitation light of a wavelength that is absorbed by a fluorescent pigment within a cue ball and that generates fluorescent emission when the cue ball is illuminated thereby; a dichroic mirror positioned in the illumination path of the light emitting source with means to pass the excitation wavelengths and to reflect the fluorescent emission wavelengths to a focusing lens that focuses the fluorescent emission wavelengths through an optical filter to a detector that is responsive to fluorescent wavelengths; means to produce an electrical current proportional to the fluorescent wavelengths striking the detector; and means to generate an output signal from the sensor when fluorescent wavelengths striking the detector generate an electrical current of a predetermined amplitude.

Another embodiment of the present invention is a ball return mechanism for a billiard table having an optical sensor for distinguishing a cue ball from an object ball as in either embodiment set forth in the immediately foregoing paragraphs.

Another embodiment of the present invention is a billiard table having a ball return mechanism with an optical sensor for distinguishing a cue ball from an object ball as in either embodiment set forth in the immediately foregoing paragraphs.

It is therefore an object of the present invention to provide optical devices to be used in the ball return mechanism of a billiard table for optically detecting the presence of a regular-sized, standard cue ball as the cue ball and object balls pass through the ball return mechanism.

DETAILED DESCRIPTION OF THE PREFERRED EMBODIMENTS

1. Optical Density Discrimination

Figure 1:
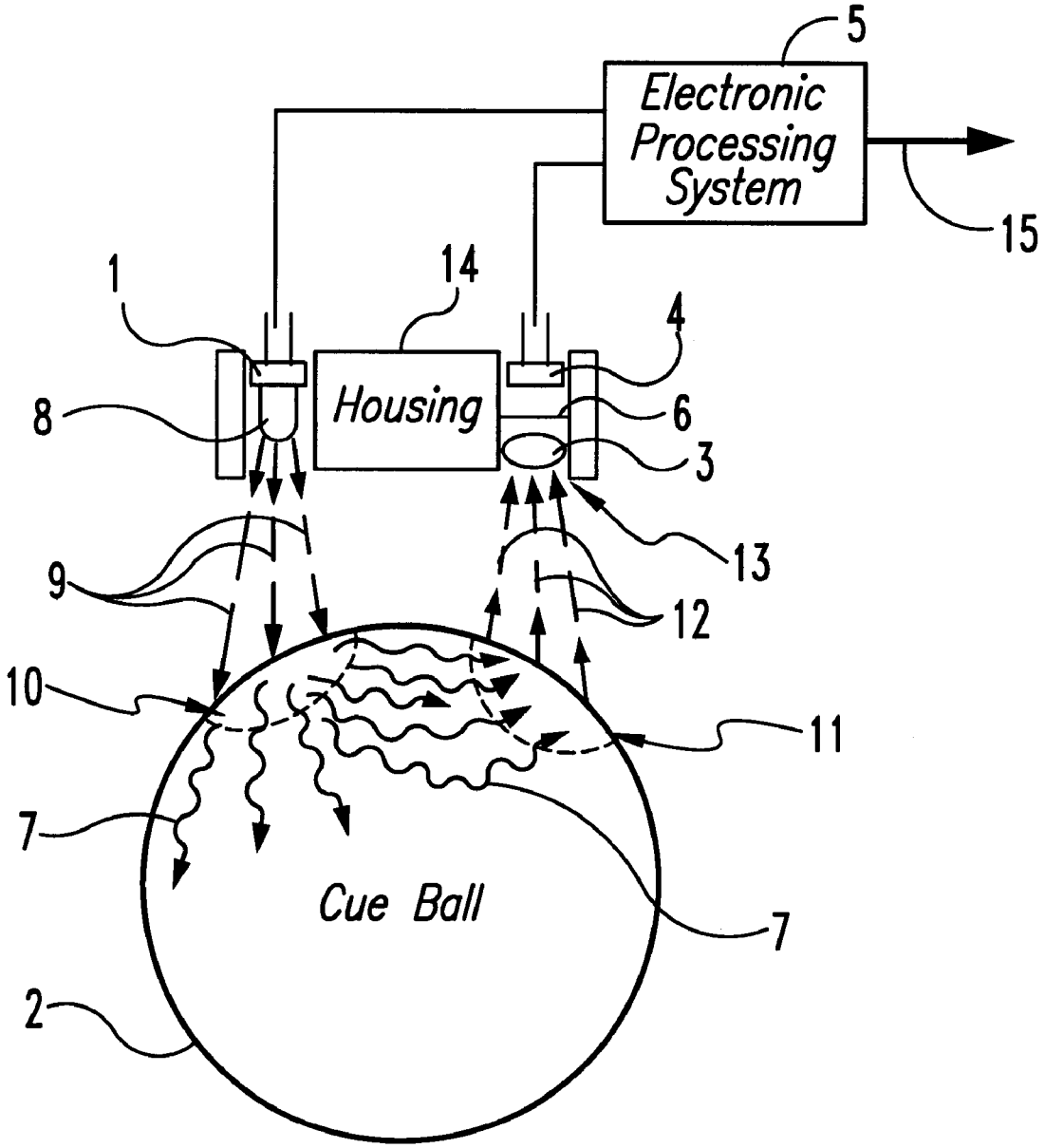
FIG. 1 shows the cue ball sensor of the present invention based on optical density discrimination.

Referring now to the drawings, FIG. 1 shows the cue ball sensor of the present invention based on optical density discrimination. The disclosed sensor comprises a light source (1), a detector (4), signal processing electronics (5), and may also have a detector lens (3) or other means to restrict the detectors field of view such as a housing aperture (13), and a filter (6). The light source may be any source emitting in the visible through infrared part of the electromagnetic spectrum. It would be desirable that the light source have a lens end package (8) in order to concentrate the illumination (9) in the forward direction. The preferred light source to date has been a GaAlAs LED-emitting light at wavelengths nominally between 830 and 930 nm. The LED has a lens end package so the light emitted is within a 16° cone angle from the end of the LED.

The detector (4) is selected to produce an electrical current proportional to the intensity of the detected light (12) striking it. The detector must be responsive to the wavelength emitted by the light source. The preferred detector to date has been a silicon PIN photodiode. The sensor must have a means to limit the field of view of the detector to an area that is not directly illuminated by the light emitting source. This restriction may be accomplished by the use of a lens (3), either incorporated into the detector package or a separate component, or by an aperture (13), which may be part of the sensor housing.

The light source and the detector are mounted in the sensor housing (14) such that there is no direct cross talk between the light source and the detector, and in fact the area illuminated (10) by the light source and the field of view (11) of the detector have zero or very limited overlap within the range of the sensor. Therefore in the case of an optically opaque object placed within the sensor's range there is no or very limited signal being generated by the detector.

When a cue ball (2) is placed in front of the sensor, light from the light source illuminates and enters into the ball. The depth of penetration of the light into the cue ball (2) is determined by the optical density of the material making up the cue ball. Optical density is defined in the art as a measure of the transmittance through an optical medium. Typically, balls do not have high optical clarity. This is particularly true for billiard balls. Therefore, in addition to the effect of optical density on the depth of penetration of the illumination, the lack of optical clarity results in a general scattering of the light that has penetrated the ball. If the illuminated ball has a low enough optical density then some of the illumination will be scattered out of the ball within the field of view of the detector and will constitute the detected light (12).

Figure 2:
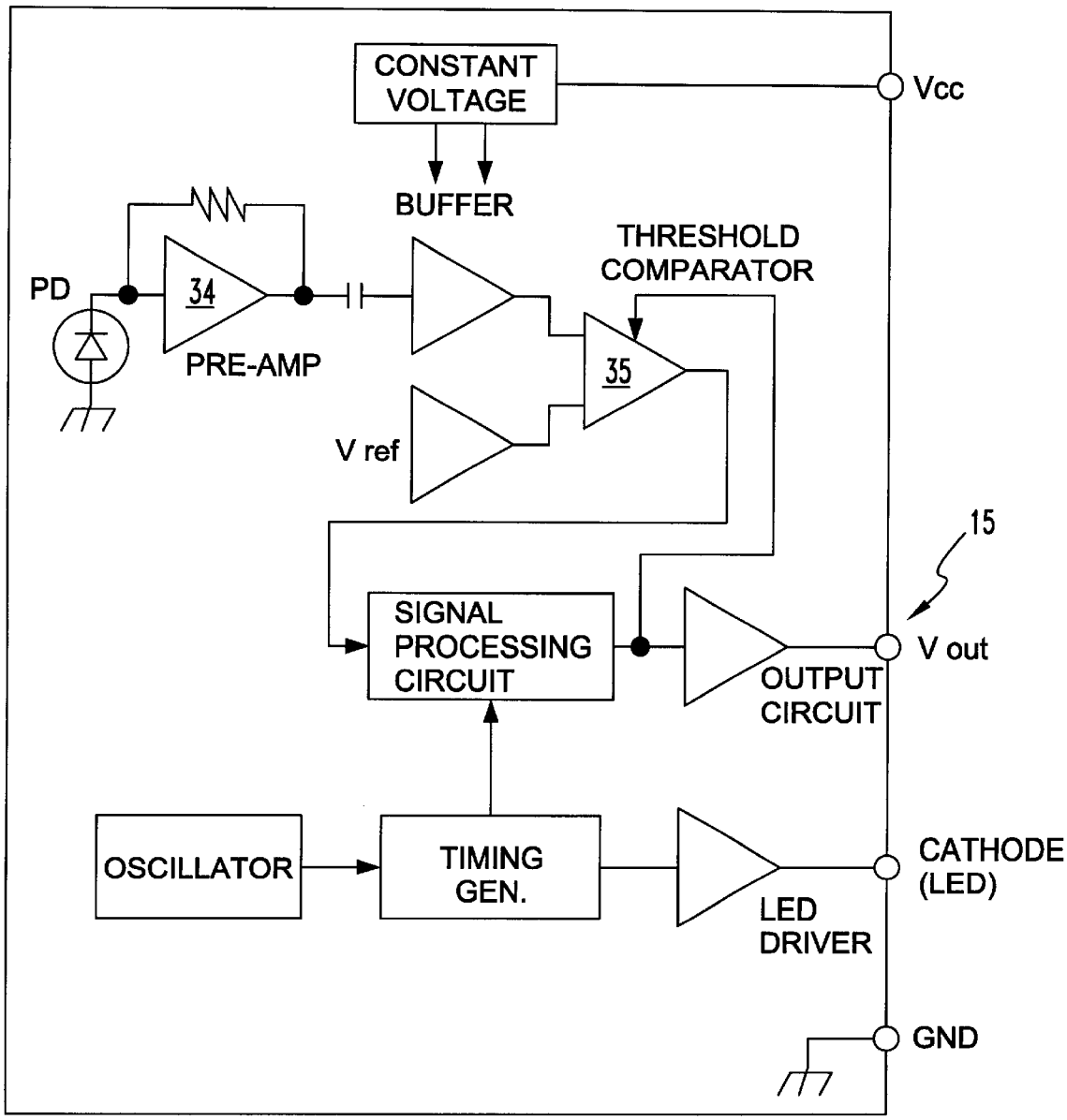
FIG. 2 shows an exemplary electronic processing system illustrated in FIG. 1.

This light will cause a signal to be generated in the electronic processing system (5). An example of an electronic processing system is shown in FIG. 2. It has as a minimum a signal amplifier (34) with a particular gain and a threshold level (35) such that if the detected light (12) from the ball is of sufficient amplitude then an appropriate sensor output (15) will be generated.

It is also desirable to have the sensor be insensitive to light from sources other than the sensor's light source. This can be accomplished using standard means such as an optical filter (6) in front of or encapsulating the detector blocking light that is not in the wavelength range of the light source or by modulating (pulsing) the light source and electronically filtering the signals in the electronic processing system so that only the frequency of the pulsing light is processed. The electronic processing system shown in FIG. 2 has the modulation feature. These optical and electronic filtering techniques are well known in the art.

Experimentation to date has shown that regular-sized, standard cue balls made from natural resin, with no added pigment, have an optical density that is detectably lower than that of the standard object balls. When the electronic processing system is set with the appropriate gain and threshold level, a cue ball placed in front of the sensor will generate an output signal but any object ball will not.

2. Fluorescence Discrimination

Figure 4:
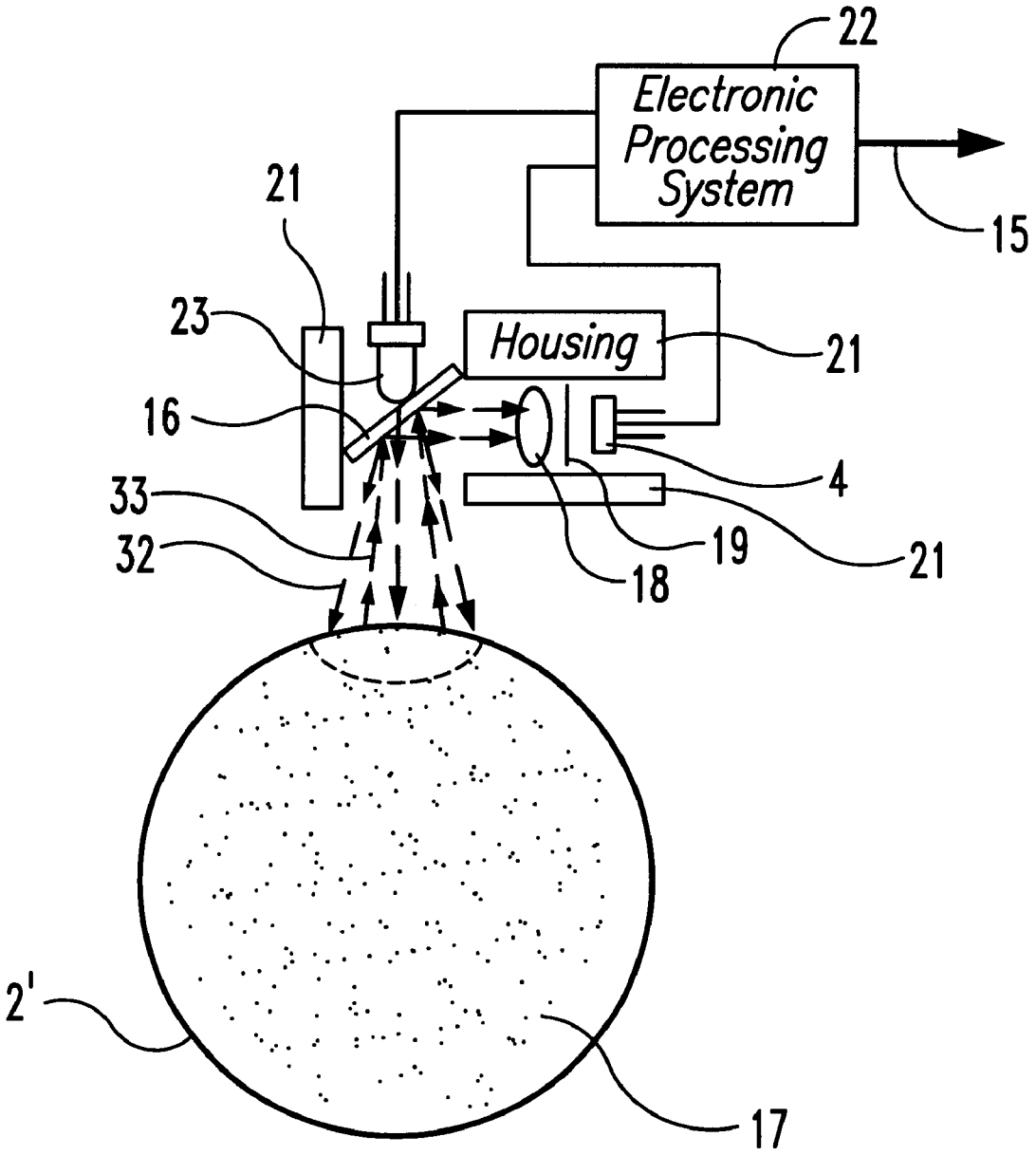
FIG. 4 shows the cue ball sensor of the present invention based on fluorescence discrimination.

FIG. 4 shows a preferred cue ball sensor of the present invention based on fluorescence discrimination. This technique requires the addition of a fluorescent pigment (17) to the cue ball (2') and the use of a fluorescence detection technique. Fluorescence detection techniques are well known in the art. For cue ball detection, it is most desirable to use a fluorescent pigment that emits in the infrared. This ensures that the appearance of the cue ball would not be effected by the added pigment. Pigments that fluoresce in the infrared when illuminated in the red or near infrared are well known in the art. The cue ball (2') is manufactured to contain the selected fluorescent pigment. A light source (23) is selected that emits excitation light (32) of the wavelength that is absorbed by the pigment and generates fluorescent emission (33).

The cue ball (2') is illuminated by the excitation light source. A dichroic mirror (16) is positioned in the illumination path. The mirror has a coating that passes the excitation light wavelengths but reflects the fluorescence emission wavelengths. The fluorescence emitted by the pigment when illuminated by the light source is reflected by the dichroic mirror to the focusing lens (18). The lens (18) focuses the light through an optical filter (19) to the detector (4). Optical filter (19) serves to pass only the fluorescent wavelengths. The signal from the detector is processed by the electronic processing circuit to produce the appropriate output, as illustrated in FIG. 2. The housing (21) holds all components in proper alignment and prevents any light from the light source from directly illuminating the detector.

The sensor of either preferred embodiment of the present invention is implemented into the ball return system of billiard tables. The sensor output from either of these embodiments is used to activate a ball selection mechanism such as that shown in FIG. 3 to separate the detected ball from balls that do not generate signals resulting in detection and separation. In this way, the cue ball can be returned for further play while the object balls are retained. The ball return system sends all balls to a central location (i.e., middle of pool table), where they will roll through the sensor. The sensor distinguishes between the object balls and the cue ball, and an electric impulse will move an actuating arm to the left or right to segregate the cue ball. The arm sends the cue ball to the right section of a ball box, and sends the object balls to a left section, for example. The right section of the ball box will be accessible to players, so that if a scratch or foul occurs, the players can obtain the cue ball for the next shot. The left section of the ball box will gather all of the object balls. The gathered object balls will not be further accessible unless monies are paid for the next game. If an object ball is made into one of the six pockets, it will be retrievable until the next game.

The ball rolls down the ball feed track (24) and past the sensor. It is important to prevent a reflection from the surface of the ball from reaching the detector and thereby causing a false signal. This is accomplished by the orientation and position of the sensor assembly (25) in relation to the ball's path of travel (30). The sensor assembly is mounted such that the sensor axis (31) of the light source and detector is perpendicular to the ball's direction of travel, and the detector and light source are equally spaced from the center or crown of the ball. This positioning ensures that all specular reflections of the light source from the surface of the ball as is passes under the sensor are away from the detector. Light from the light source must pass through and be scattered by the ball to be detected by the detector.

Figure 3:
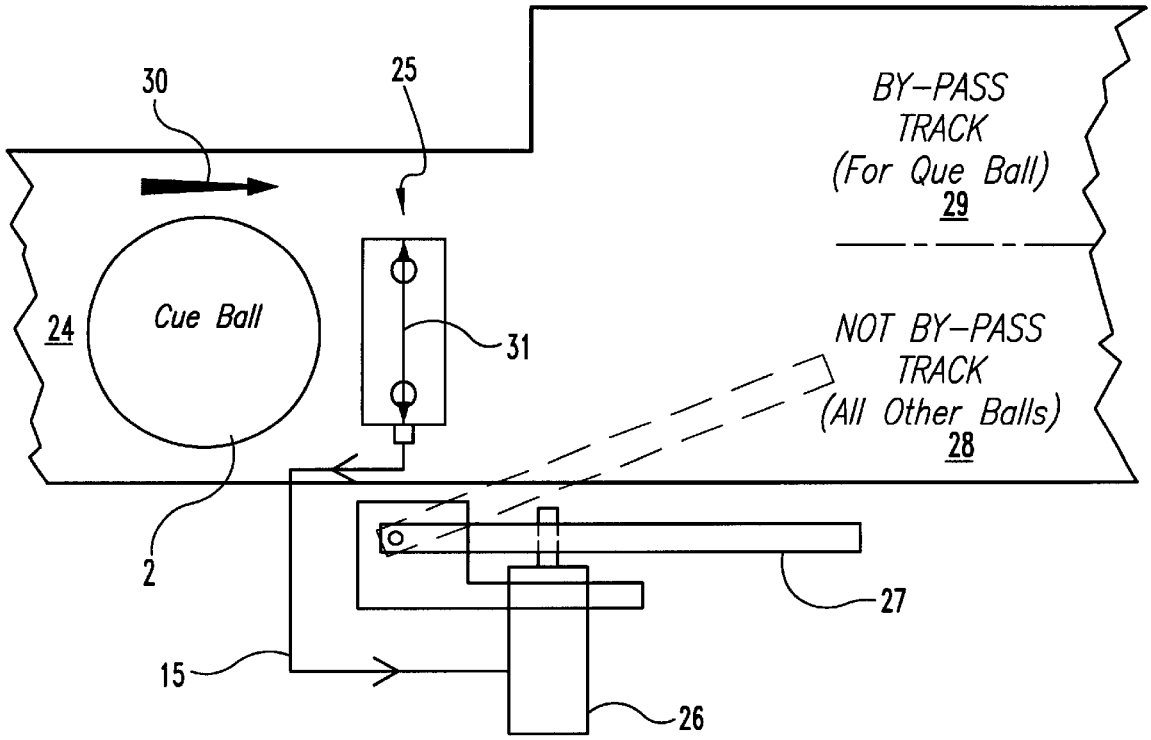
FIG. 3 shows an exemplary ball selection mechanism that may be activated with the cue ball sensors of the present invention.

Referring still to FIG. 3, when the cue ball passes under the sensor the output signal (15) is generated causing push solenoid (26) to activate and push lever arm (27). This diverts the cue ball into the by-pass track (29). The sensor must respond with an appropriate speed to activate the push solenoid. Alternatively, a delay may be built into the electronic processing system to ensure proper timing between the sensor, the activation of the solenoid and the position of the ball. Object balls will not generate an output signal and will continue unobstructed down the not by-pass track (28).

The "ball box" may contain a number of different options based upon a commercial customer's needs.

1. The ball box can be open on both the right and left if this is a home table allowing the customer to play games without inserting monies.

2. A coin changer can be retrofitted.

3. A dollar bill changer can be retrofitted.

4. A debit card accounter can be utilized.

5. A per/game system can be set up or an on time system can be chosen

All of the options are excellent and many more are possible. They will benefit the commercial room owners in many significant ways; however, the optical techniques for ball detection of the present invention are the first that permit the use of regular-sized, standard professional cue balls. These cue balls have not been poured with magnet cores or produced larger than the object balls (i.e., oversized). The professional cue balls are the correct size and weight, and will decidedly enhance the sport of amateur billiards.

We claim:

1. An optical sensor for distinguishing a cue ball from an object ball, comprising a light emitting source with means to concentrate or limit its illumination to a portion of a cue ball;

a detector responsive to the wavelength emitted by the light emitting source having means to limit the field of view of the detector to an area of the cue ball not directly illuminated by the light emitting source;

means to produce an electrical current proportional to the detected light striking the detector; and means to generate an output signal from the sensor when detected light striking the detector generates an electrical current of a predetermined amplitude.

2. The optical sensor of claim 1 and further including a housing in which the light emitting source and the detector are mounted whereby there is no overlap between them within the range between the sensor and the cue ball.

3. An optical sensor for distinguishing a cue ball having a fluorescent pigment therein from an object ball, comprising a light emitting source that emits excitation light of a wavelength that is absorbed by a fluorescent pigment within a cue ball and that generates fluorescent emission when the cue ball is illuminated thereby;

a dichroic mirror positioned in the illumination path of the light emitting source with means to pass the excitation wavelengths and to reflect the fluorescent emission wavelengths to a focusing lens that focuses the fluorescent emission wavelengths through an optical filter to a detector that is responsive to fluorescent wavelengths;

means to produce an electrical current proportional to the fluorescent wavelengths striking the detector; and means to generate an output signal from the sensor when fluorescent wavelengths striking the detector generate an electrical current of a predetermined amplitude.

4. The optical sensor of claim 3 and further including a housing in which the light emitting source and detector are mounted in a manner such that the light emitting source does not directly illuminate the detector.

5. An optical sensor for distinguishing a cue ball from an object ball as in either claim 1 or claim 3, and further comprising a ball return mechanism for a billiard table.

6. An optical sensor for distinguishing a cue ball from an object ball as in either claim 1 or claim 3, and further comprising a billiard table having a ball return mechanism.

7. A method for distinguishing and separating a cue ball from object balls, comprising:

providing an optical sensor having a light emitting source with means to concentrate or limit its illumination to a portion of a cue ball; a detector responsive to the wavelength emitted by the light emitting source having means to limit the field of view of the detector to an area of the cue ball not directly illuminated by the light emitting source; means to produce an electrical current proportional to the detected light striking the detector; and means to generate an output signal from the sensor when detected light striking the detector generates an electrical current of a predetermined amplitude, detecting the difference in optical density between the cue ball and the object balls, and activating a separation mechanism to separate the cue ball from the object balls based on the detected difference.

8. A method for distinguishing and separating a cue ball from object balls, comprising:

providing an optical sensor having a light emitting source that emits excitation light of a wavelength that is absorbed by a fluorescent pigment within a cue ball and that generates fluorescent emission when the cue ball is illuminated thereby; a dichroic mirror positioned in the illumination path of the light emitting source with means to pass the excitation wavelengths to a focusing lense that focuses the fluorescent emission wavelengths through an optical filter to a detector that is responsive to flourescent wavelengths; means to produce an electrical current proportional to the fluorescent wavelengths striking the detector; means to generate an output signal from the sensor when fluorescent wavelengths striking the detector generate an electrical current of a predetermined amplitude; a cue ball with a fluorescent pigmentation and object balls without fluorescent pigmentation;

detecting the difference in fluorescent pigmentation between the cue ball and the object balls; and activating a separation mechanism to separate the cue ball from the object balls based on the detected difference in fluorescent pigmentation.

* * * * *